US011428069B2

(12) United States Patent
Affleck et al.

(10) Patent No.: US 11,428,069 B2
(45) Date of Patent: Aug. 30, 2022

(54) SYSTEM AND METHOD FOR CONTROLLING ANNULAR WELL PRESSURE

(71) Applicants: Saudi Arabian Oil Company, Dhahran (SA); E-Flow Control Limited, Aberdeen (GB)

(72) Inventors: Michael Affleck, Aberdeen (GB); Ian Allan, Aberdeen (GB)

(73) Assignees: Saudi Arabian Oil Company, Dhahran (SA); ELECTRO-FLOW CONTROLS LTD, Aberdeen (GB)

( * ) Notice: Subject to any disclaimer, the term of this patent is extended or adjusted under 35 U.S.C. 154(b) by 24 days.

(21) Appl. No.: 16/848,468

(22) Filed: Apr. 14, 2020

(65) Prior Publication Data

US 2021/0317722 A1 Oct. 14, 2021

(51) Int. Cl.

| | |
|---|---|
| ***E21B 21/08*** | (2006.01) |
| ***E21B 21/10*** | (2006.01) |
| ***E21B 34/02*** | (2006.01) |
| ***E21B 34/08*** | (2006.01) |

(52) U.S. Cl.

CPC ..... *E21B 34/025* (2020.05); *E21B 34/08* (2013.01)

(58) Field of Classification Search

CPC ..... E21B 21/08; E21B 21/106; E21B 34/025; E21B 34/08

See application file for complete search history.

(56) References Cited

U.S. PATENT DOCUMENTS

| | | | | |
|---|---|---|---|---|
| 9,605,502 | B2 * | 3/2017 | Leuchtenberg | E21B 33/038 |
| 9,988,866 | B2 * | 6/2018 | Cotten | E21B 21/106 |
| 10,107,052 | B2 | 10/2018 | Northam et al. | |
| 10,712,190 | B1 * | 7/2020 | Parker | G01F 1/845 |

(Continued)

FOREIGN PATENT DOCUMENTS

| | | | |
|---|---|---|---|
| WO | 2016040272 A1 | 3/2016 | |
| WO | WO-2016062314 A1 * | 4/2016 | E21B 21/08 |

(Continued)

OTHER PUBLICATIONS

Frink, Philip. "Managed Pressure Drilling—What's in a Name?" IADC, 2006, iadc.org/dcpi/dc-marapr06/Mar06-suri.pdf. Accessed Nov. 1, 2019.

(Continued)

*Primary Examiner* — Matthew R Buck

(74) *Attorney, Agent, or Firm* — Leason Ellis LLP

(57) ABSTRACT

A fast-acting managed pressure drilling rig is disclosed. A main valve configured as an alternative for a conventional rotating control device is provided to control drilling of a wellbore. A second valve is configured to trap pressure in the wellbore. A choke valve maintains well bottomhole pressure within specified limits by trapping pressure or by releasing trapped pressure within the wellbore. A pressure relief choke is configured to provide fine pressure stability control within the well and to act as a pressure relief valve in response to wellbore overpressure. A controller is configured with at least one processor to affect operation of the main valve, the second ratio valve, the choke valve, and the pressure relief choke in response to information received by the controller representing operation of the managed pressure drilling rig.

19 Claims, 14 Drawing Sheets

(56) References Cited

U.S. PATENT DOCUMENTS

| | | | | |
|---|---|---|---|---|
| 2013/0192841 | A1 | 8/2013 | Feasey et al. | |
| 2016/0138350 | A1 | 5/2016 | Havre et al. | |
| 2017/0044857 | A1* | 2/2017 | Leuchtenberg | E21B 33/085 |
| 2018/0328127 | A1 | 11/2018 | Ravi et al. | |
| 2018/0328128 | A1 | 11/2018 | Ravi et al. | |
| 2019/0195032 | A1* | 6/2019 | Clark | E21B 17/01 |
| 2021/0010338 | A1* | 1/2021 | Santos | E21B 21/106 |
| 2021/0172284 | A1* | 6/2021 | Khorshidian | E21B 44/06 |

FOREIGN PATENT DOCUMENTS

| | | | | |
|---|---|---|---|---|
| WO | 2016118150 | A1 | 7/2016 | |
| WO | 2016179136 | A1 | 11/2016 | |
| WO | WO-2018042186 | A1 * | 3/2018 | E21B 21/001 |
| WO | WO-2020231996 | A1 * | 11/2020 | E21B 21/001 |

OTHER PUBLICATIONS

International Search Report and Written Opinion; PCT/US2021/026889; WIPO; dated Jun. 17, 2021.

* cited by examiner

SYSTEM AND METHOD FOR CONTROLLING ANNULAR WELL PRESSURE

FIELD OF THE DISCLOSURE

This patent disclosure relates generally to managed pressure drilling, and, more particularly, to a fast-acting fluid control device for controlling annular well pressure.

BACKGROUND OF THE DISCLOSURE

Controlling annular pressure throughout a wellbore during well drilling is difficult to achieve, despite various techniques such as managed pressure drilling. One method of managed pressure drilling strives to maintain wellbore pressure by increasing surface pressure. By ascertaining and sustaining bottomhole pressure and by managing annular hydraulic pressure, an increased well depth can be reached and problems encountered, such as stuck pipe can be mitigated.

Despite the advantages of managed pressure drilling, several shortcomings remain. Choke based systems that precisely control surface and therefore downhole pressure can be substantial, in the amount of equipment and number of crew required to operate and maintain. The more precise the pressure stability and control specification the more substantial and complex the system.

Existing methods to maintain constant bottomhole pressure for jointed drill pipe applications often use a rotating control device. Such methods also employ a choke-based backpressure generating system with controls. The rotating control device provides a dynamic seal between the outside diameter of the drill pipe and the well (i.e., the surface environment). Dry blow out prevention applications, such as land or jackup rigs, position the rotating control device above an annular preventer on the blow out preventer stack. Further, the choke system is driven by controls that enables well backpressure to be varied dynamically, depending on particular operational requirements. Simply put, the control systems seek to minimize downhole annular pressure fluctuations. Managed pressure drilling and accompanying control systems can be configured to operate in a manual, semi-automatic or fully automatic mode, as needed to control and maintain a constant or stable pressure regime.

The selection of hardware and respective operational controls in managed pressure drilling systems is influenced by the level of wellbore pressure stability that may be required for the drilled section. Simple manual systems offer the simplest installation but often provide the least pressure stability, particularly in unplanned operational circumstances such as circulatory system failure. Advanced control systems, such as that include multiple choke-based systems, often require a more challenging and costly installation. Additionally, a crew is needed to operate and maintain the equipment. Such advanced control systems, however, provide higher levels of pressure stability than manual or less complex systems, including in response to both planned and unplanned (e.g., contingency) operations.

The need to achieve an acceptable, reliable, and predictable seal and bearing assembly in a rotating control device is often challenging and cited as a significant factor in the decision not to use managed pressure drilling. Existing rotating control device technology relies on the sealing element being in constant contact with the running string and, as such, is subject to wear. Notwithstanding many applications in which surface backpressure is not required during circulation, rotating control device seals are nevertheless constantly engaged and, therefore, still subject to wear. For example, running string external surface condition (tong marks) and dimension changes (tool joints) coupled with dynamic specifications associated with pipe rotation and stripping speeds often lead to costly catastrophic rotating control device seal failure.

Accordingly, managed pressure drilling can be considered an enabling technology that can significantly reduce or eliminate well construction operational and geological risk. Unfortunately, current technology associated with managed pressure drilling is unreliable, complex, and expensive, and requires additional supporting personnel. For example, some conventional managed pressure drilling systems can alternate, via rotating control device operations, between one mode (e.g., managed pressure drilling mode) and another mode (e.g., non-managed pressure drilling mode). Adjusting for the rig to operate between modes can be slow, perhaps at least 30 minutes, although often much longer in cases where flowline reconfiguration is required.

Furthermore, conventional managed pressure drilling arrangements typically require a dedicated (e.g., closed pipe) flowline to carry return fluids from the well annulus to a choke system for applying varying amounts of backpressure. In a typical arrangement, the additional well backpressure can vary from approx. 15-60 psi when one or more choke valves are fully open. The additional well backpressure can be much higher and can vary from up to 1000-1500 psi, when the choke valves are closed or nearly closed, such as during connections or emergency off events (e.g., during a rig power system failure).

These and other shortcomings in conventional managed pressure drilling arrangements have resulted in limited widespread adoption of managed pressure drilling. It is with respect to this background that the present disclosure is addressed.

SUMMARY OF THE DISCLOSURE

According to one or more implementations consistent with the present disclosure, a system and method are provided for controlling annular well pressure during a pipe connection process in a managed pressure drilling rig. A controller that is configured with at least one processor identifies pipe movement stability, wherein the pipe movement stability is identified as a function of information representing stoppage of pipe rotation, positioning of a pipe in slips, or both. Further, the controller determines, in response to information representing a pump ramp down process, well bottomhole pressure that is below a predetermined threshold value. The controller further closes, in response to the well bottomhole pressure being below the predetermined threshold value, a main valve configured with the managed pressure drilling rig, while maintaining, by the controller, a second valve in an open position and a first choke in an open position. The second valve and the first choke are also configured with the managed pressure drilling rig. Further, after the main valve is closed, the controller closes at least one of the first choke and a second choke, and maintains the second valve in the open position, wherein the bottomhole pressure is trapped as a function of the main valve and at least one of the first choke and second choke being closed sequentially. Further, the annular well pressure is maintained as a function of the trapped pressure, thereby enabling breakage of the pipe connection without further reducing the bottomhole pressure.

In certain implementations, the information representing stoppage of pipe rotation or positioning of a pipe in slips is received from a pressure transmitter that is configured with the managed pressure drilling rig to measure pressure and transmit, to the controller, information representing pressure, component operational status, drilling rig performance, or a combination of the foregoing.

In certain implementations, the system and method further comprise establishing, by the controller as a function of a calibration ramp schedule, a pressure change associated with a change in flow rate in accordance with the pump ramp down process.

In certain implementations, the information representing stoppage of pipe rotation or positioning of a pipe in slips is derived from top drive revolutions per minute, rotary table position, block position, iron roughneck activation, slips activation, or at least one image captured by a camera, or a combination of the foregoing.

In certain implementations, the controller closes the main valve prior to closing, by the controller, at least one of the first choke and the second choke is in accordance with information representing a continuing of the pump ramp down process.

In certain implementations, after the main valve is closed the controller closes the choke or chokes to control the well bottomhole pressure.

In certain implementations, the second choke is further configured to provide fine pressure stability control and to act as a pressure relief valve in response to overpressure.

In certain implementations the second valve is a hydraulically controlled or pneumatically controlled gate valve.

According to one or more implementations consistent with the present disclosure, a system and method are provided for controlling annular well pressure during an unexpected interruption during operation of a managed pressure drilling rig. A controller which is configured with at least one processor identifies a reduction in well bottomhole pressure as a function of information representing reduced flow. In response to the well bottomhole pressure being below a predetermined threshold value, the controller closes a main valve and a second valve which are configured with the managed pressure drilling rig, while maintaining a choke configured with the managed pressure drilling rig in an open position. When in a closed position, the main valve and the second valve operate to trap the bottomhole pressure. Further, after the main valve and the second valve are closed, the controller closes a pressure relief choke valve configured with the managed pressure drilling rig, wherein the pressure relief choke operates as a pressure controlling valve. Further, after the pressure relief choke valve is closed, the controller closes a choke valve, wherein the bottomhole pressure is trapped as a function of the main valve, the second valve, the pressure relief choke and the choke valve being closed, thereby enabling troubleshooting a cause of the unexpected interruption.

In certain implementations, the system and method further comprise generating, by the controller, an alarm to stop pipe movement, wherein the alarm is generated in response to the well bottomhole pressure being below a predetermined threshold value.

In certain implementations, the reduced flow is derived as a function of derived standpipe pressure or pump strokes parameters.

In certain implementations, the information representing the reduced flow is received from a pressure transmitter that is configured with the managed pressure drilling rig to measure pressure and transmit, to the controller, information representing pressure, component operational status, drilling rig performance, or a combination of the foregoing.

In certain implementations, the pressure relief choke is further configured to provide fine pressure stability control and to act as a pressure relief valve in response to overpressure.

In certain implementations, the second valve is a hydraulically controlled or pneumatically controlled gate valve.

According to one or more implementations consistent with the present disclosure, a fast-acting managed pressure drilling rig comprises a main valve configured as an alternative for a conventional rotating control device to control drilling of a wellbore. Further, the fast-acting managed pressure drilling rig comprises a second valve configured to trap pressure in the wellbore, and a choke valve, designed to maintain well bottomhole pressure within specified limits by trapping pressure or by releasing trapped pressure within the wellbore. Still further, the fast-acting managed pressure drilling rig comprises a pressure relief choke configured to provide fine pressure stability control within the well and to act as a pressure relief valve in response to wellbore overpressure. Moreover, the fast-acting managed pressure drilling rig comprises a controller configured with at least one processor to affect operation of the main valve, the second valve, the choke valve, and the pressure relief choke in response to information received by the controller representing operation of the managed pressure drilling rig.

In certain implementations, the main valve is further configured to provide rapid sealing between a drill string outside diameter and a well annulus.

In certain implementations, the main valve, the second valve, the choke, and the pressure relief choke are controllable by the controller as a function of inputs received over a data network.

In certain implementations, the controller is configured to respond to characteristics of components in the rig and to provide responses the identify a respective stage of a connection, and the controller is further configured to maintain bottomhole pressure stability in the wellbore by controlling the main valve, the second valve, the choke, and the pressure relief choke.

In certain implementations, the second valve is a hydraulically controlled or pneumatically controlled gate valve.

Additional features, advantages, and embodiments of the disclosure may be set forth or apparent from consideration of the detailed description and drawings. Moreover, it is to be understood that the foregoing summary of the disclosure and the following detailed description and drawings provide non-limiting examples that are intended to provide further explanation without limiting the scope of the disclosure as claimed.

BRIEF DESCRIPTION OF THE DRAWINGS

The accompanying drawing figures illustrate exemplary embodiments and are not intended to be limiting of the present disclosure. Among the drawing figures, like references are intended to refer to like or corresponding parts.

DETAILED DESCRIPTION OF CERTAIN EMBODIMENTS ACCORDING TO THE DISCLOSURE

By way of overview and introduction, the present disclosure provides systems and methods to improve managed pressure drilling, including for trapped backpressure and safety driven fluid diverter applications. Further, the present disclosure addresses packaging and various complexities associated with managed pressure drilling equipment and improves the capabilities of such equipment. For example, the teachings herein include manual and automatic controls that are operable to identify, detect and respond quickly to a need for annular pressure change during drilling operations. In one or more implementations of the present disclosure, such response can include rapidly sealing the well annulus, thereby trapping pressure created by fluid circulation in the closed (i.e., sealed) well.

In one or more implementations of the present disclosure, bottomhole pressure difference between the drilling fluid equivalent circulating density and equivalent static density is reduced, thereby reducing the number and length of non-productive events. Such events can include, for example, influxes or kicks and borehole collapse, which can result from problems associated with open hole wellbore pressure. Further, in managed pressure drilling arrangements that include a diverter, controls are provided that enable a user to rapidly divert harmful fluid flow, including hydrocarbons, from the drilling rig floor area. The ability to respond rapidly to divert the fluid flow from the rig floor area further contributes to the effectiveness of the systems and methods disclosed herein.

The present disclosure provides improvements to known managed pressure drilling arrangements by simplifying structures. For example, the present disclosure improves upon known managed pressure drilling systems with a simpler mechanical system that requires far less drilling rig upgrade and installation time, and fewer personnel to operate and maintain. Further, the present disclosure improves in-well bottomhole annular pressure stability by up to approximately 75%, and does so with a reduction of equipment (e.g., 20% of the equipment) and at significantly lower cost (e.g., 20% of the cost).

Furthermore, when a managed pressure drilling arrangement of the present disclosure is circulating normally, the operations are effectively inactive or passive. That is, all valves including a main valve are fully or substantially fully open and the effective additional backpressure on the well is very low, such as below 10 psi. This can be made possible at least in part due to a conventional flowline mud return to a treatment system.

Figure 1:
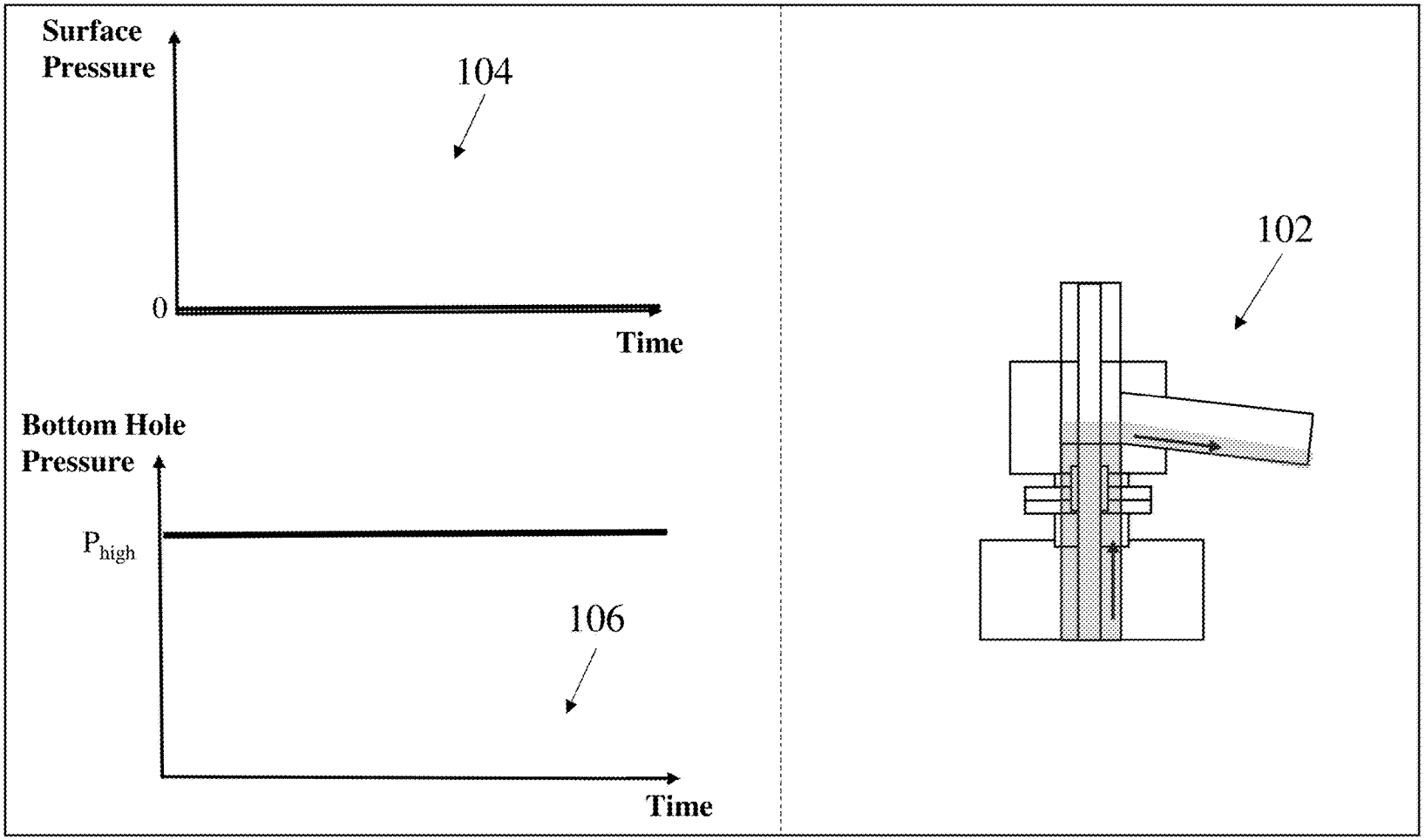
FIG. 1 PRIOR ART
FIG. 1 illustrates a conventional managed pressure drilling arrangement.

Referring now to the drawings, in which like reference numerals refer to like elements, FIG. 1 illustrates a conventional or non-managed pressure drilling arrangement 102 in accordance with the prior art, while arrangement 102 is open to atmospheric pressure during circulation. Continuing with reference to FIG. 1, line graph 104 represents pressure at the surface over time and line graph 106 represents pressure at the bottomhole, in connection with the prior art conventional drilling arrangement 102. In FIG. 1, arrangement 102 illustrates fluid flow and level through a drilling rig riser, spool, diverter, and flow-line assembly.

Figure 2:
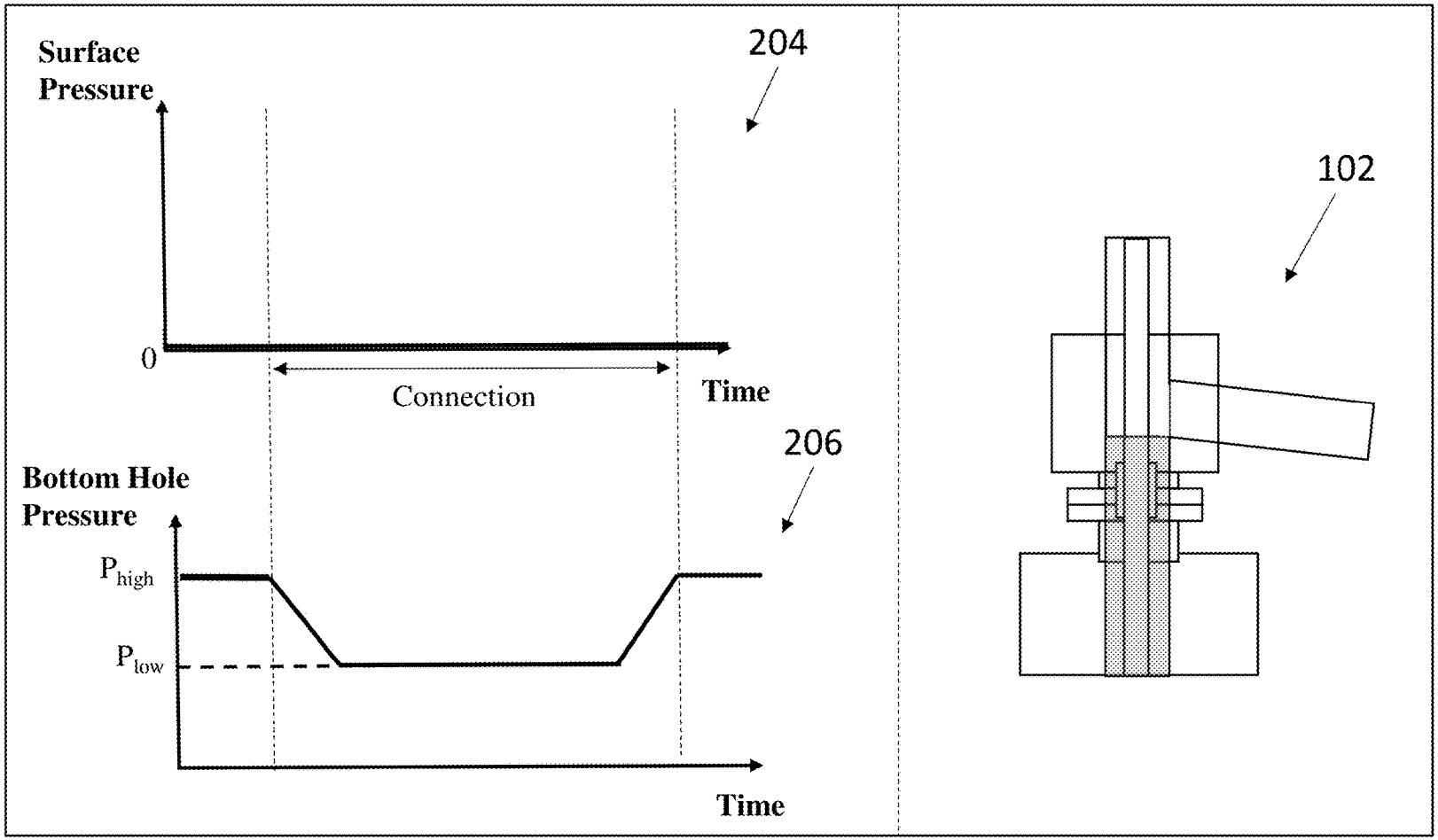
FIG. 2 PRIOR ART
FIG. 2 illustrates a conventional managed pressure drilling arrangement while open to atmospheric pressure during a connection process.

FIG. 2 illustrates a conventional (non-managed pressure) drilling arrangement 102 while open to atmospheric pressure during a connection process, such as to add and remove elements from the running string. In the example shown in FIG. 2, during circulation the drilling arrangement 102 has no flow, which is represented in FIG. 2. Line graph 204 represents pressure at the surface over time, including during the time of connection processes. Line graph 206 represents bottomhole pressure, which fluctuates from high pressure ($P_{high}$) to low pressure ($P_{low}$) and then back to high pressure ($P_{high}$), in response to the connection process. In FIG. 2, arrangement 102 illustrates fluid flow and level through a rig riser, spool, diverter, and flow-line assembly during a period of no flow, such as a during connection and circulation is stopped to add or remove elements from the running string.

Accordingly, and as shown in FIGS. 1 and 2, there is no pressure varying capability at the surface during circulation or during connections for conventional drilling. The surface is always at zero (relative) or at atmospheric pressure. FIG. 1 indicates the simple weir effect when drilling fluid exits the well into the flowline during circulation. FIG. 2 shows the fluid level maintained during a connection or other no-flow condition. During a linear ramp connection, such as represented in FIG. 2, the bottomhole pressure falls from $P_{high}$ to $P_{low}$ as the well flow reduces. The difference between $P_{high}$ and $P_{low}$ can be attributed to friction force created with fluid flowing to surface in the annular space, i.e., between the drill pipe and the wellbore. Extended reach wells often have long sections with compromised annular area that can lead to a more significant differential between $P_{high}$ and $P_{low}$. Moreover, deeper wells sometimes require heavier drilling fluids that can also lead to challenging pressure variations.

Figure 3:
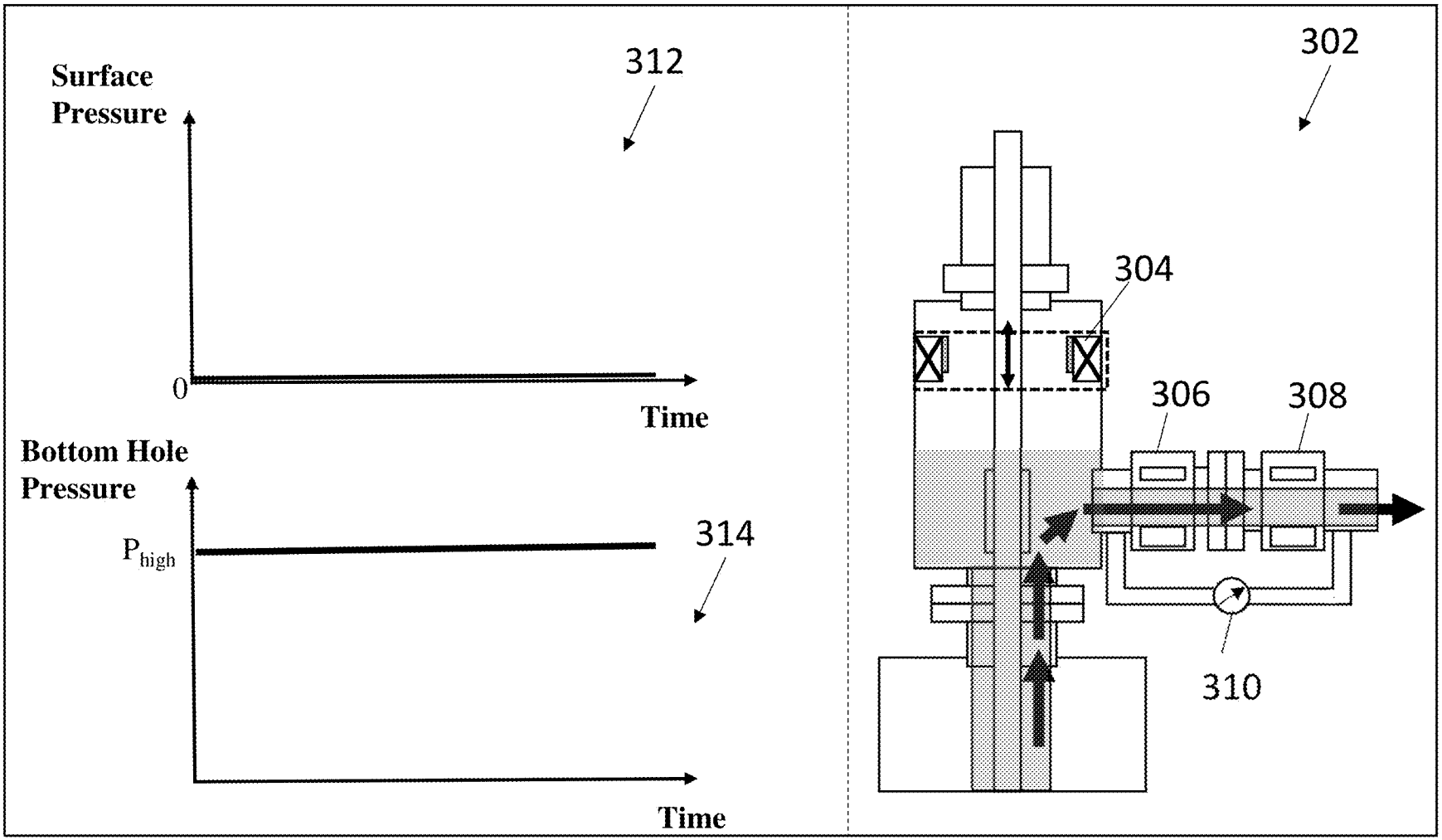
FIG. 3 illustrates a managed pressure drilling arrangement in accordance with an implementation of the present disclosure.

FIG. 3 illustrates a managed pressure drilling arrangement 302 in accordance with an implementation of the present disclosure. In the example shown in FIG. 3, arrangement 302 includes main valve 304, which in FIG. 3 is shown in a wide-open position to facilitate tubular movement. In addition, arrangement 302 includes valve 306 and choke 308 that are operable to minimize surface backpressure and maintain bottomhole pressure. Line graph 312 represents pressure at the surface over time and line graph 314 represents bottomhole pressure, in connection with the managed pressure drilling arrangement 302. In FIG. 3, managed pressure drilling arrangement 302 illustrates fluid flow and level during steady state circulation. As illustrated in graph 312, the circulating pressure status is unchanged from the prior art arrangement shown in FIG. 1 (i.e., managed pressure drilling arrangement 102). More particularly, surface pressure remains level at atmospheric pressure and, as shown in graph 314, bottomhole pressure is unchanged and represented as $P_{high}$.

Figure 4:
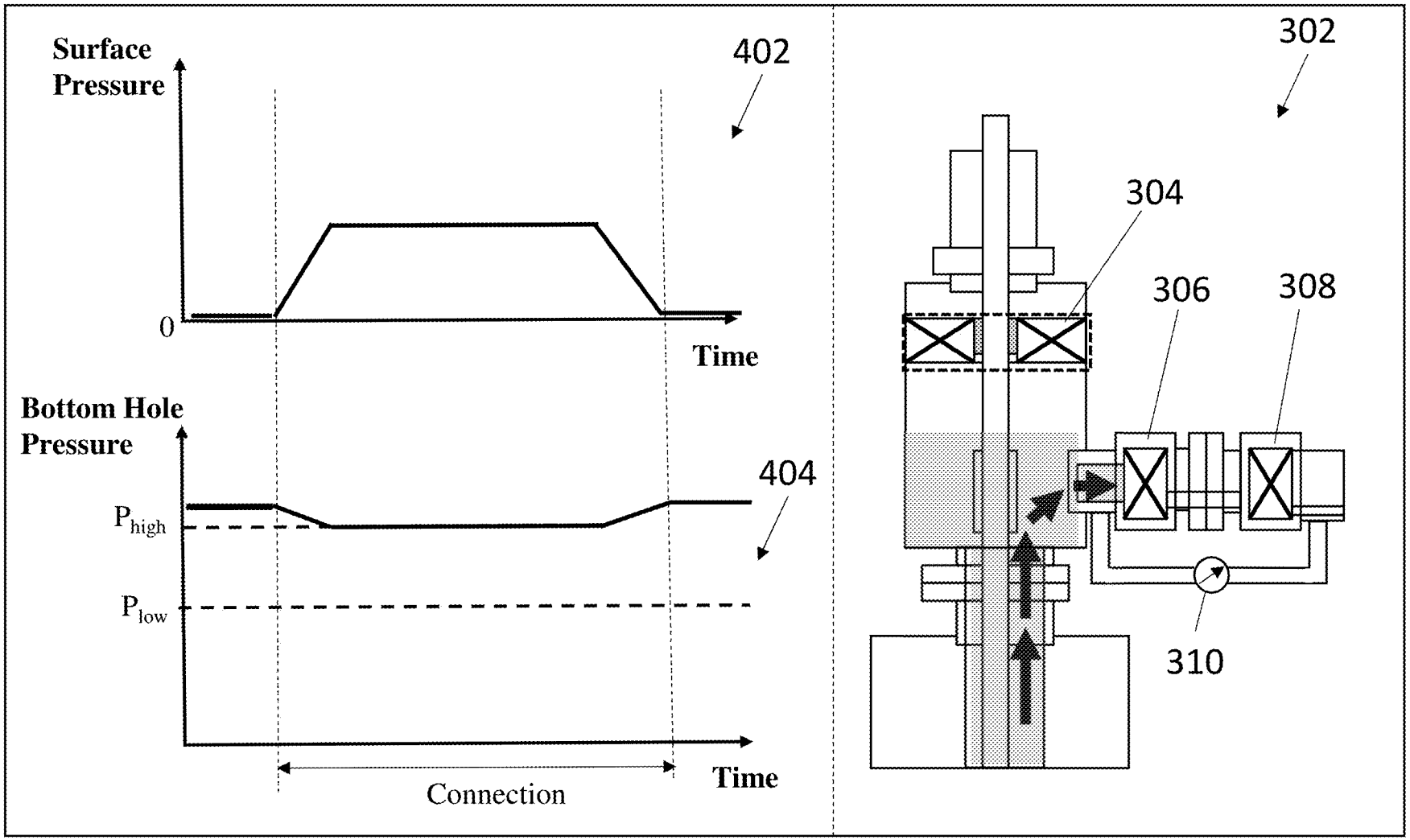
FIG. 4 illustrates the managed pressure drilling arrangement during a connection process, such as to add and remove elements from the running string.

FIG. 4 illustrates the managed pressure drilling arrangement 302 during a connection process, such as to add and remove elements from the running string. In the example shown in FIG. 4, main valve 304 is in a closed position, which permits well annulus pressure containment. Line graph 402 represents pressure at the surface over time, including during the time while connections occur. Line graph 404 represents bottomhole pressure, which reduces from high pressure ($P_{high}$) and then back to high pressure ($P_{high}$), in response to the connection process. Referring back to FIG. 2, arrangement 102 provides fluid flow and level through a rig riser, spool, diverter, and flow-line assembly during a period of no flow, such as during a connection when circulation is stopped to add or remove elements from the running string.

In accordance with the present disclosure, even during a connection state, as shown in FIG. 4, an applied surface pressure is achieved as a function of "trapping" pressure. This ensures that the bottomhole pressure does not fall to $P_{low}$ and is maintained closer to $P_{high}$, even during the period when a drill pipe (or other tubular) is added or removed from the running string.

In one or more implementations of the present disclosure, the main valve 304 operates in part as a conventional rotating control device, and effects a seal between the running pipe outside diameter and the well annulus. Main valve 304 can be actuated manually, semi-automatically, or automatically very quickly, such as in under five seconds. When main valve 304 is in a closed or sealed position, limited pipe rotation and reciprocation may be possible, without any stripping of tool joints. Alternatively, when main valve 304 is in an open or retracted position, all tubular string dimensional access is available.

In one or more implementations, main valve 304 is not designed to control or choke flow from the well annulus. Such functionality is provided by the combination of valves, including a valve 306, choke 308, and pressure relief choke ("PRC") 310. In one or more implementations of the present disclosure, valve 306 can be a rapid response/close valve that is usable to trap pressure quickly, such as in the event of a sudden unplanned mud pump failure. Valve 306 can be, for example, a hydraulically, pneumatically or other kind of operated gate valve, such as a "Choke Line Valve," an "F Type Valve," or other suitable valve (including as known in the art), and valve 306 can be configured to work in combination with main valve 304 to quickly effect a seal on the annular and effectively trap pressure. In one or more implementations, valve 306 can be configured various ways, including to eliminate one or more components in applications that have modest pressure stability requirements or expectations.

Continuing with reference to FIGS. 3 and 4, in one or more implementations choke valve 308 is a highly proportional choke valve, and one that is slower responding. Choke valve 308 is preferably capable of trapping or releasing pressure, for example, to hold bottomhole pressure within particular limit(s). In addition, a secondary choke valve, illustrated as parallel control choke valve 310, can be configured with managed pressure drilling arrangement 302, and is particularly usable for smaller trims to achieve fine pressure stability control. Parallel control choke valve 310 can also function as a pressure relief choke valve, for example, in the event of system overpressure.

Figure 5:
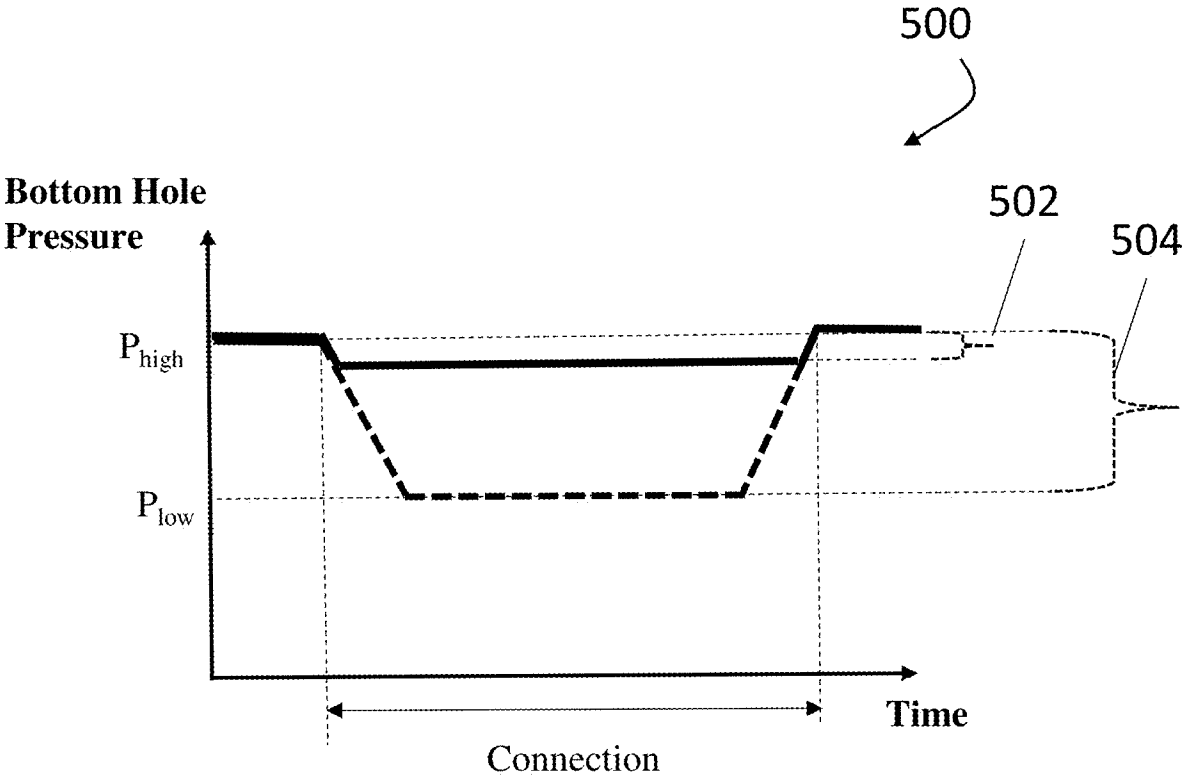
FIG. 5 shows an example graph representing the difference of bottomhole pressure profiles during a connection period for conventional (non-managed pressure) drilling and for managed pressure drilling in accordance with the present disclosure.

Turning now to FIG. 5, an example graph 500 is shown in which the difference of bottomhole pressure profiles during a connection period for conventional drilling and for managed pressure drilling in accordance with the present disclosure is illustrated. More particularly, the respective differences between $P_{high}$ and $P_{low}$ are shown in difference 502, representing the difference between $P_{high}$ and $P_{low}$ in accordance with the present disclosure and difference 504, representing the difference between $P_{high}$ and $P_{low}$ in accordance with conventional drilling. In the example shown in FIG. 5, the pressure change during a connection is shown to be approximately 20% of the full pressure change, when drilling conventionally.

Figure 6:
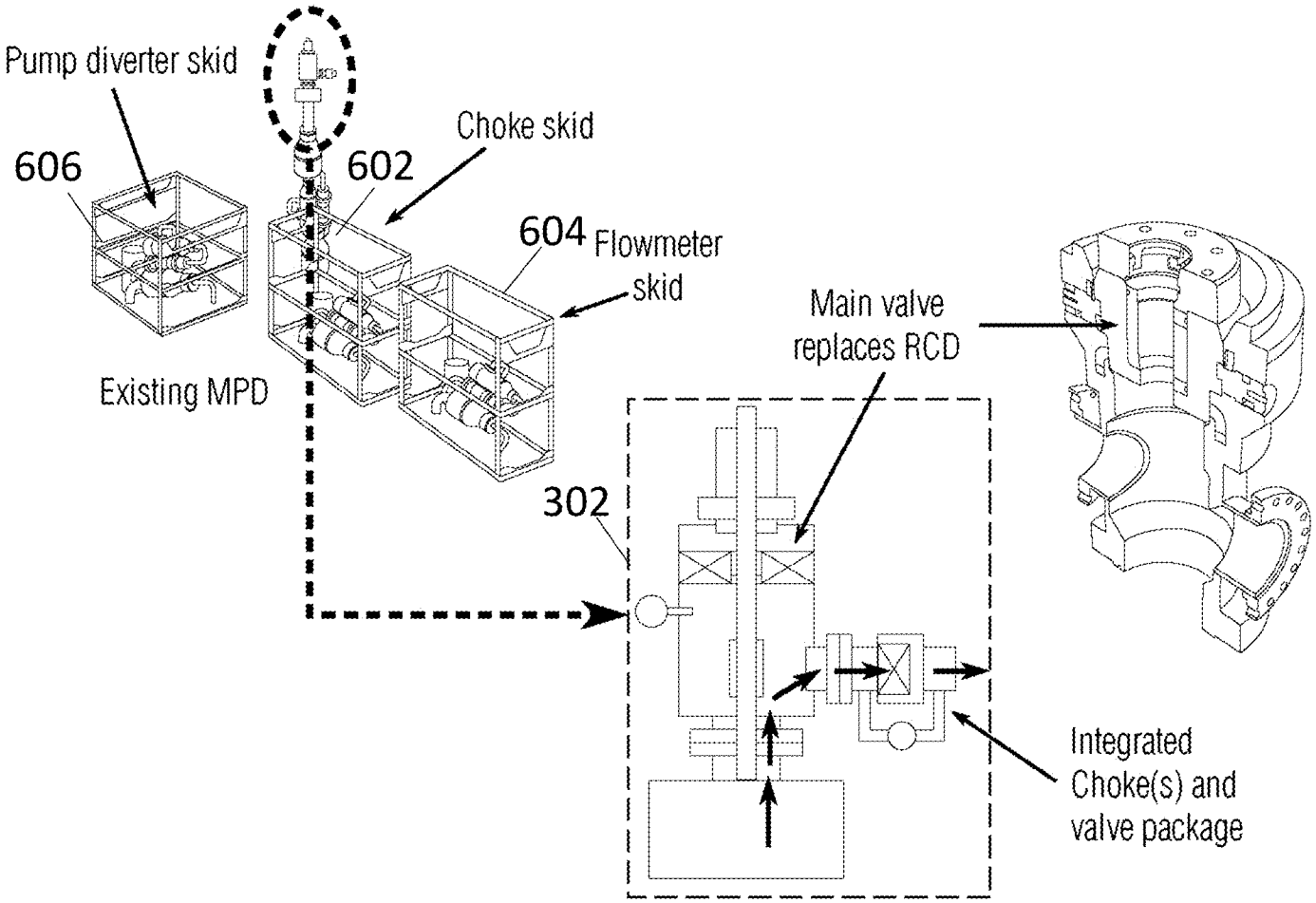
FIG. 6 displays an integration of a conventional managed pressure drilling rig with an example managed pressure drilling arrangement of the present disclosure.

FIG. 6 displays (not to scale) an integration of a conventional managed pressure drilling rig with an example managed pressure drilling arrangement 302. One of ordinary skill in the industry will recognize that elements of conventional managed pressure drilling systems include a rotating control device, a dual choke manifold (illustrated in FIG. 6 in choke skid 602), a flowmeter (illustrated in FIG. 6 in flowmeter skid 604), a backpressure pump/diverter (illustrated in FIG. 6 in diverter skid 606), as well as other high-pressure valves, connectors, crossovers and piping to connect (not numerated). Such a system can take many hours, if not days, to install and commission. As illustrated in FIG. 6, a conventional managed pressure drilling rig can be outfitted with components of the present disclosure to convert the conventional drilling rig. In one or more implementations, at least one riser section is positioned sufficiently above main valve 302 to ensure that backpressure during full rig circulation (with all main flow valves open) does not cause fluid to deviate or spill from designated flow paths. By converting the circulatory system of a conventional drilling rig from a zero-surface annulus pressure system to a trapped pressure managed pressure drilling system, the present disclosure affords benefits shown and described herein, including by reducing the time otherwise required to close the main valve, additional valves, or choke valves rapidly, such as in under five seconds.

Moreover, by eliminating a rotating control device, the managed pressure drill arrangement of the present disclosure eliminates a need to be in an "always on" state. For example, after a seal cartridge is run in a conventional managed pressure drilling rig, it is always designed to seal between the drill pipe (or connection) outside diameter and the well annulus, which requires the rotating control device to operate. Alternatively, a conventional trap pressure managed pressure drilling system may combine the "always on" rotating control device, high pressure pipework, and a simple, remote manual choke skid. Surface backpressure (i.e., choke) control can be provided in a conventional arrangement by one or more simple algorithms (e.g., proportional and integral mode algorithm) to regulate a choke valve position in accordance with a surface backpressure setpoint. For example, in a conventional trap pressure managed pressure drilling arrangement, the surface backpressure setpoint may be 50 psi when drilling ahead, and the surface backpressure setpoint may be 500 psi while in a connection or other mode. The managed pressure drilling arrangement of the present disclosure eliminates the rotating control device and, correspondingly, the operational need for the arrangement to be in an always on state, or to apply algorithms to regulate a choke valve position.

Figure 7:
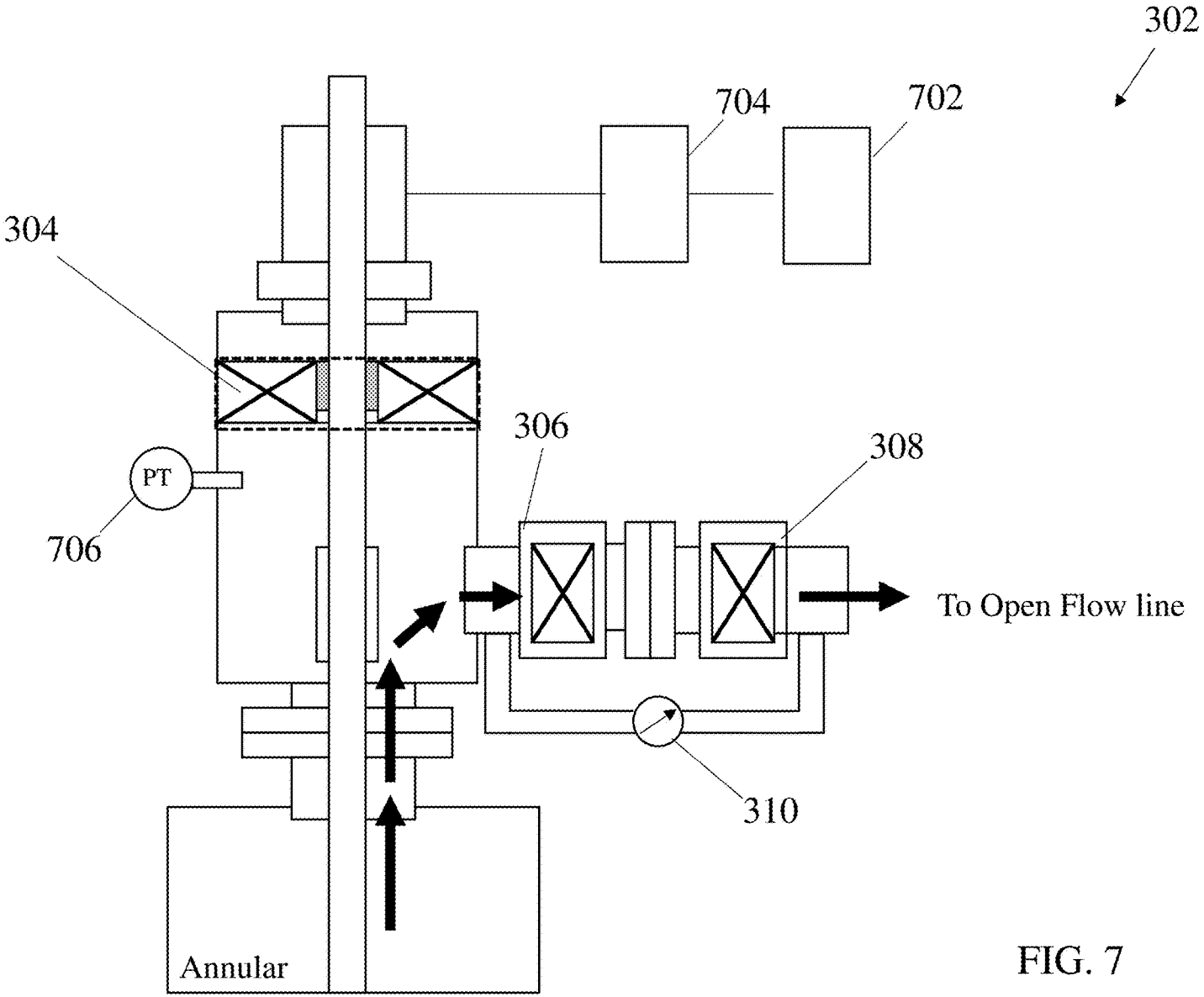
FIG. 7 is a block diagram illustrating an example managed pressure drilling arrangement in accordance with the present disclosure.

FIG. 7 is a block diagram illustrating an example managed pressure drilling arrangement 302 in accordance with the present disclosure. The arrangement 302 shown in FIG. 7 (and represented in FIG. 6) demonstrates the simplicity and reduced size associated with an example configuration. For example, main valve 304 replaces conventional rotating control device, and arrangement 302 further includes an integrated pressure varying arrangement comprising valve 306, choke 308, and pressure relief choke 310. Also included in FIG. 7 is a system controller 704 and operator graphical user interface 702. Although components 704 and 702 are illustrated in FIG. 7 as in close proximity to the main valve 304, the controller 704 and interface 702 can be located remotely or some physical distance away from main valve 304. In one or more implementations, the controller 704 is configured for data processing, and can include a central processing unit, a microprocessor, and can be configured as a computing device that includes elements of a computer, such as memory, communications device(s), a display, input/output devices, network connectivity, and the like.

As will become clear to one of ordinary skill, the managed pressure drilling apparatus 302 of the present disclosure improves on conventional managed pressure drilling systems and methods, at least in part due to a substantial reduction in equipment size and complexity, and the corresponding ease of installing and un-installing the apparatus in a fraction of the time that would be otherwise required with conventional technology.

Continuing with the implementation illustrated in FIG. 7, main valve 304 can provide a fast closing element that seals around a tubular pipe body. Valve 306, choke 308, and pressure relief choke 310 can be opened or closed in sequence during connections, or other activation-triggering events. Moreover, pressure transmitter 706 can be configured to measure pressure, as well as to detect other system variables relating to overall status and performance Pressure transmitter 706 can further be configured to provide feedback, such as via one or more data communication modules, to be transmitted to the controller 704. Thus, apparatus 302 can be configured with a single pressure measuring devices, as opposed to a plurality of devices, as found in conventional managed pressure drilling apparatuses.

Figure 8:
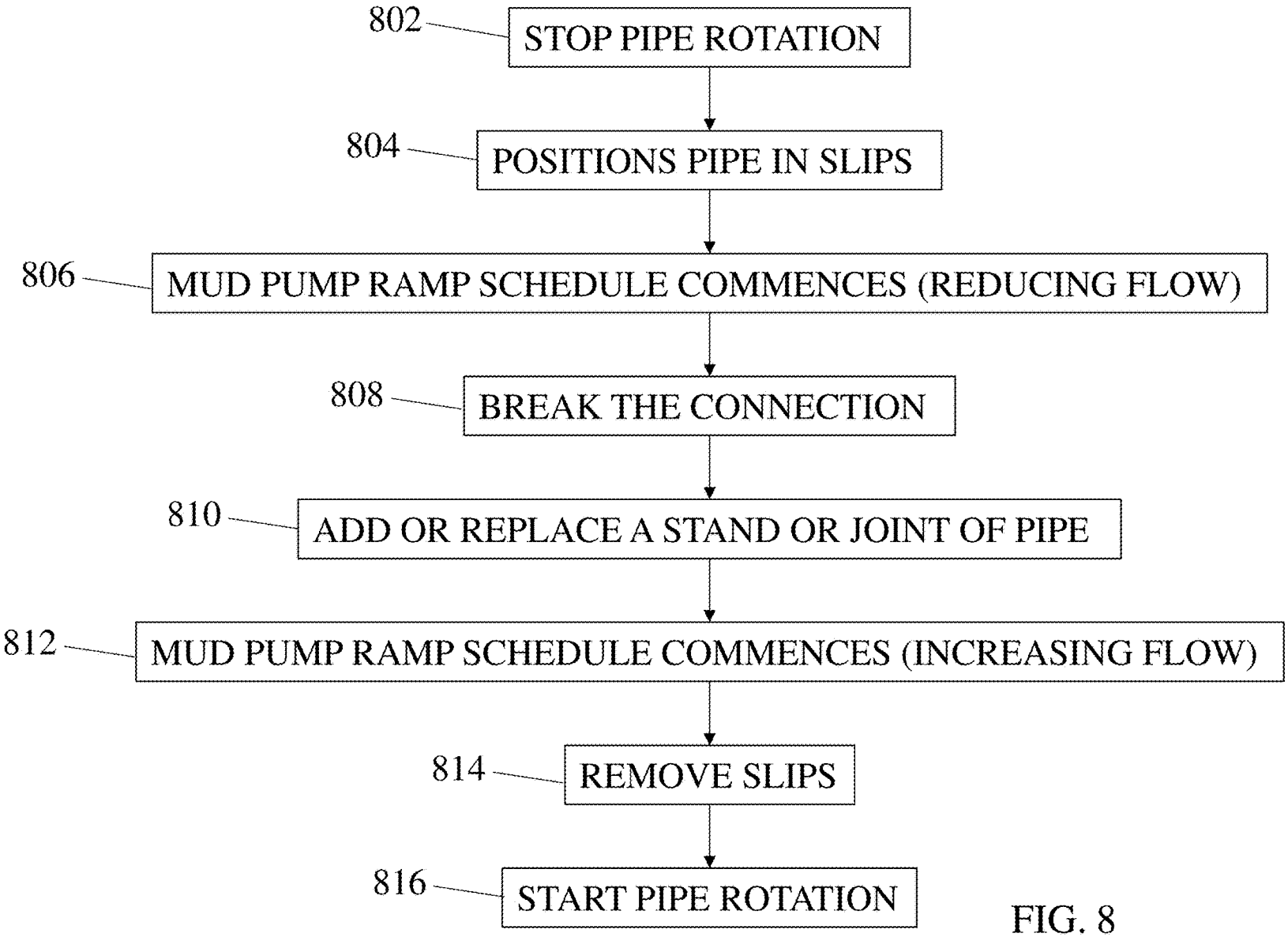
FIG. 8 is a flow diagram illustrating a broad aspect of a method for a partial connection sequence, in accordance with one or more embodiments of the present disclosure.

Turning now to FIG. 8, a flow diagram is shown of routine 800 that illustrates a broad aspect of a method for a partial connection sequence, in accordance with one or more embodiments of the present disclosure. The connection sequence routine 800 demonstrates improvement over conventional methods by eliminating steps and by reducing time and effort, as well improving bottomhole pressure. At step 802, the process begins by halting pipe rotation. Pipe movement is preferably stopped, at least in part, to account for main valve 304 which may not be configured to accommodate significant pipe movement after the seal is in an engaged or closed position. Thereafter, at step 804, the pipe is positioned in slips. Thereafter at step 806, flow is reduced, such as pursuant to a mud pump ramp schedule. For example, the calibration ramp schedule can be developed through a calibration routine performed to establish the pressure change associated with flowrate change or can be based on a simple hydraulic model to calculate a desired surface pressure to trap or hold. At step 808, a respective connection is broken, and at step 810, a stand or joint of pipe is added or replaced. Thereafter, at step 810, the flow increases in response to commencement of the mud pump ramp schedule. The slips are, thereafter, removed (step 812) and the pipe rotation is started (step 814). It is to be appreciated that the respective steps 800 associated with a partial connection sequence do not require flow to be reduced or stopped at the very start of the process, nor does flow have to be increased or started at the very end of the process, as is common in conventional systems. Instead, mud pump ramp schedules can accommodate reducing/increasing flow within the process, which decreases the time otherwise needed when a well is inactive. This is far more efficient than conventional systems, and significantly improves maintaining pressure stability.

In one or more implementations, at least some of the steps in FIG. 8 can be implemented by one or more automated devices. As a function of feedback transmitted, for example, via pressure transmitter 706 (FIG. 7) over a respective data network (not shown) associated with the managed pressure drilling arrangement 302, programming instructions can be executed to affect at least some of routine 800. In the alternative (or in addition), one or more dedicated system instruments can identify and provide feedback representing one or more stages of the sequence to an interface. The feedback can be used for manual intervention or for automatic intervention via system controller 704, interface 702, or both the controller and the interface.

Figure 9:
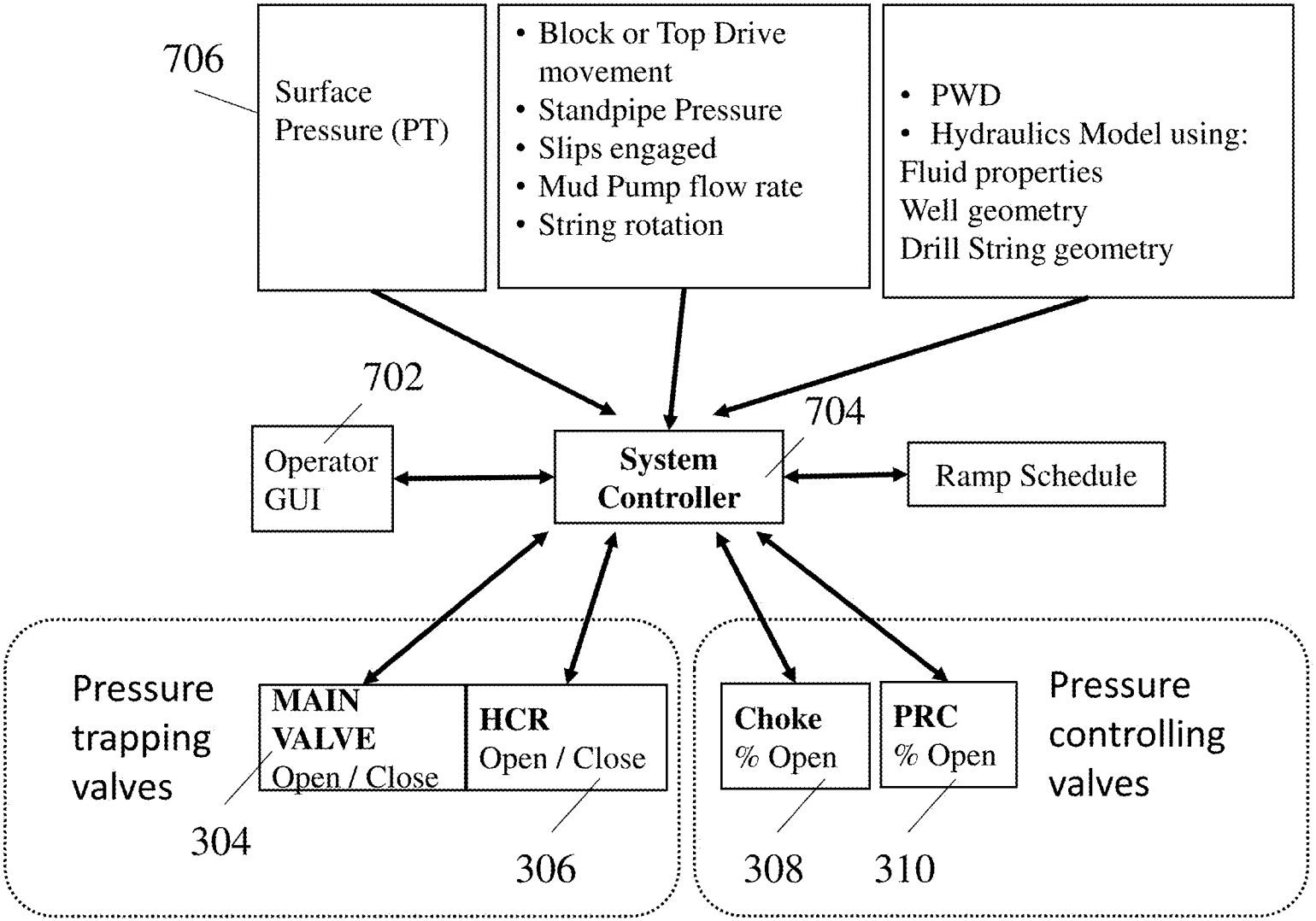
FIG. 9 displays steps associated with example interactions of the controller with various components of an example managed pressure drilling arrangement.

Details regarding the controller 704 and its operations are now further described with reference to FIGS. 9-12. FIG. 9 displays components and interactivity associated with example interactions of the controller 704 in connection with an example managed pressure drilling arrangement 302. The controller 704 can be configured to receive input from various components and, for example, to determine various system states. For example, the controller 704 can receive information from the pressure transmitter 706 that can be used, for example, by the controller 704 to calculate bottomhole pressure. Using information received from the pressure transmitter 706 and by making determinations therefrom, various components of a managed pressure drilling arrangement in accordance with the present disclosure can be monitored or controlled. For example, the controller 704 can monitor and optionally control block or top drive movement, standpipe pressure, slips function, flow rate of a mud pump, and string rotation, such as to achieve a respective surface well annulus pressure, aligned with associated bottomhole pressure stability variables and preferred operational design.

Continuing with FIG. 9, parameter data representing pressure while drilling ("PWD"), for example, can be received by the controller 704 over a data network and used in combination with system instrumentation. The controller 704 can be configured to use the parameter data to identify and classify managed pressure drilling status modes, and to cause certain corresponding action to occur, such as to control pressure trapping valves and pressure controlling chokes. For example, the controller 704 can operate to control pressure during drilling as a function of fluid properties, well geometry, drill string geometry, or a combination of these. In addition, the controller 704 can be configured to generate and transmit instructions to control (e.g., open or close) pressure trapping valves, such as main valve 304, valve 306, or both valves. Furthermore, pressure controlling valves, such as choke 308 and pressure relief choke 310, can be configured via the controller 704 to open or close to a respective percentage and, thereby, control flow. Moreover, the controller 704 can receive, transmit, or both receive and transmit ramp scheduling, and further can send/receive information via operator graphical user interface 702.

As noted herein, a managed pressure drilling arrangement 302 is particularly well-suited for activity associated with planned connection operations. Arrangement 302 is similarly well-suited for handling unplanned activity, such as after an unplanned drop in annular pressure.

Figure 10:
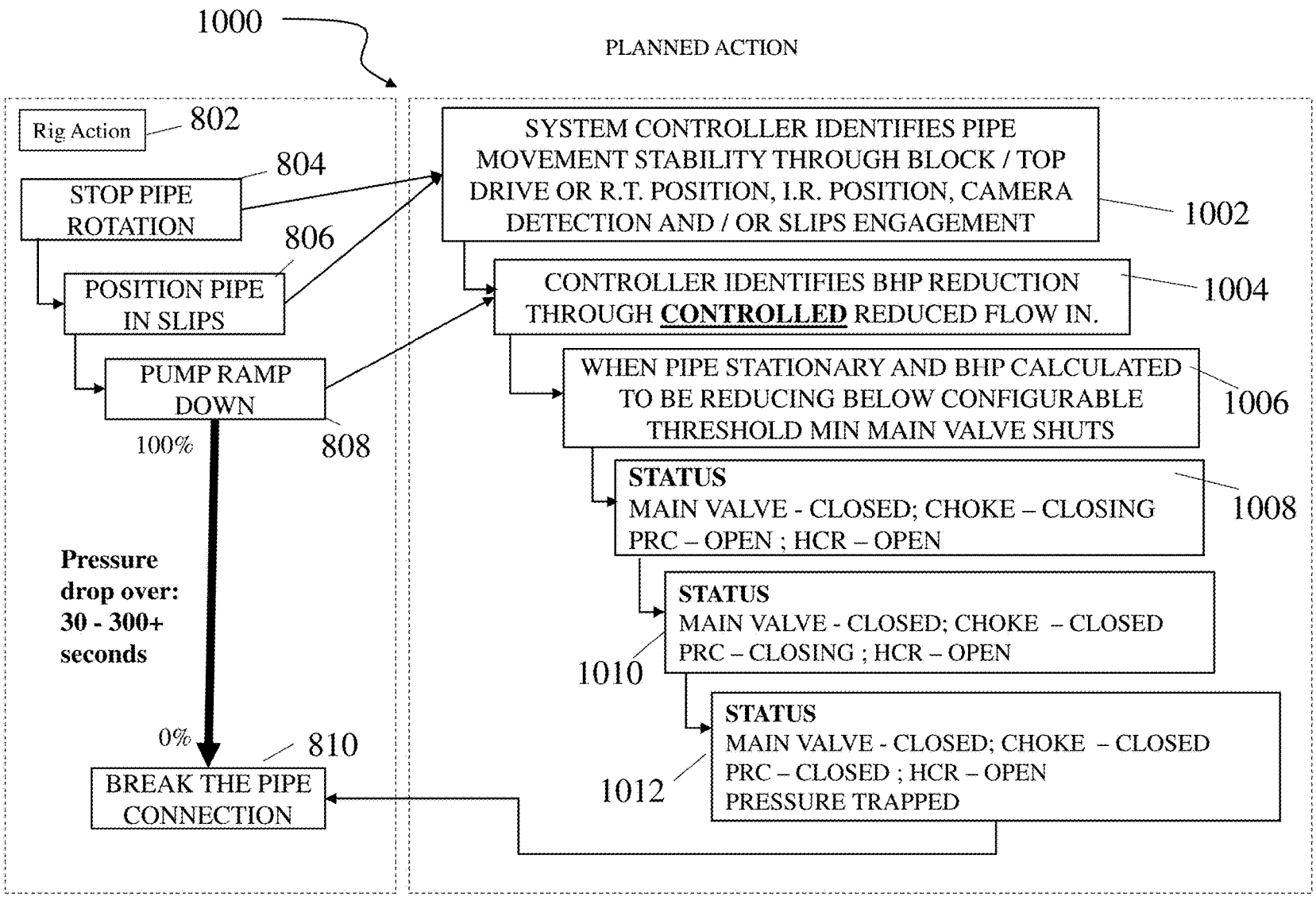
FIG. 10 is a flowchart that includes example steps performed by the controller in accordance with a planned connection sequence, and which correspond in greater detail with steps shown in FIG. 8.

FIG. 10 is a flowchart that includes example steps 1000 performed by the controller 704 in accordance with a planned connection sequence, and which correspond in greater detail with steps 802-808 (FIG. 8). Prior to starting the connection, the drilling rig is presumed to be circulating at full rate and the tubular string is rotating or reciprocating, as would be expected during drilling, reaming or other well conditioning operations. For example, all valves and chokes are open (main valve 304, valve 306, choke 308, and pressure relief choke 310), thereby minimizing backpressure on the well. The valve 306, choke 308, and pressure relief choke 310 can be controlled using inputs from the drilling rig data network or using calibration setpoints determined through performance of example connections, or using both inputs. In some instances, pressure relief choke 310 can be open or closed during full circulation, as this valve does not contribute to full flow backpressure when valve 306 and choke 308 are open.

Continuing with reference to FIG. 10, the status of drilling rig, as identified by the controller 704, is that pipe rotation is stopped or to be stopped (802) and to be positioned in slips (804). This determination can be made as a function of information received by the controller 704 over a data network (step 1002). For example, the controller 704 can receive information relating to the top drive's revolutions per minute ("RPM"), rotary table position, block position and speed, iron roughneck activation, slips engagement parameters, information from other sensors, such as camera-based systems, or a combination of the foregoing. In one or more implementations, main valve 304 activates and deactivates automatically based on input from existing rig data systems. Example control system inputs (e.g., activation/deactivation) can include hook position (e.g., string movement), pipe rotation, slips activation, mud pump status, and standpipe pressure.

Continuing with reference to FIG. 10, at step 1004, the controller 704 identifies and reduces bottomhole pressure, as a function of controlled reduced in-flow. During ramp down (808), the controller 704 identifies flow change through information received via a connection to the rig's data network. For example, standpipe pressure, mud pump strokes parameters, or both are identified and the controller 704 identifies bottomhole pressure reduction, calculates bottomhole pressure reduction, or both. In one or more implementations, the controller 704 can use a calibration ramp schedule established through a calibration routine performed to establish the pressure change associated with flowrate change. Alternatively, the controller 704 can run a simple hydraulic model to calculate the required surface pressure to trap or to hold and maintain. In one or more implementations, when pipe stationary and equivalent circulating density is below a configurable threshold value, main valve 304 shuts (step 1006). One threshold value may be 90% of a user defined, or controller calculated full circulating rate, taken from pump strokes. Another threshold may be a 20% drop in standpipe pressure from the previous full rate or maximum value. All other valves (e.g., valve 306), chokes (e.g., choke 308 and pressure relief choke 310), or both are maintained in the open position (step 1006). Thereafter, as the pump ramps down, the process continues as the main valve 304 remains shut, valve 306 remains open, choke 308 closes, and pressure relief choke 310 is maintained in the open position (step 1008). As the pump continues to ramp down, the main valve 304 remains shut, valve 306 is open, choke 308 is closed, and pressure relief choke 310 is closing (step 1010). As the pump continues to ramp down, the main valve 304 remains shut, valve 306 is open, choke 308 is closed, and pressure relief choke 310 is closed (step 1012). The pressure is, at the point in the process at step 1012, is trapped. Thereafter, the pipe connection can be broken (810).

Figure 11:
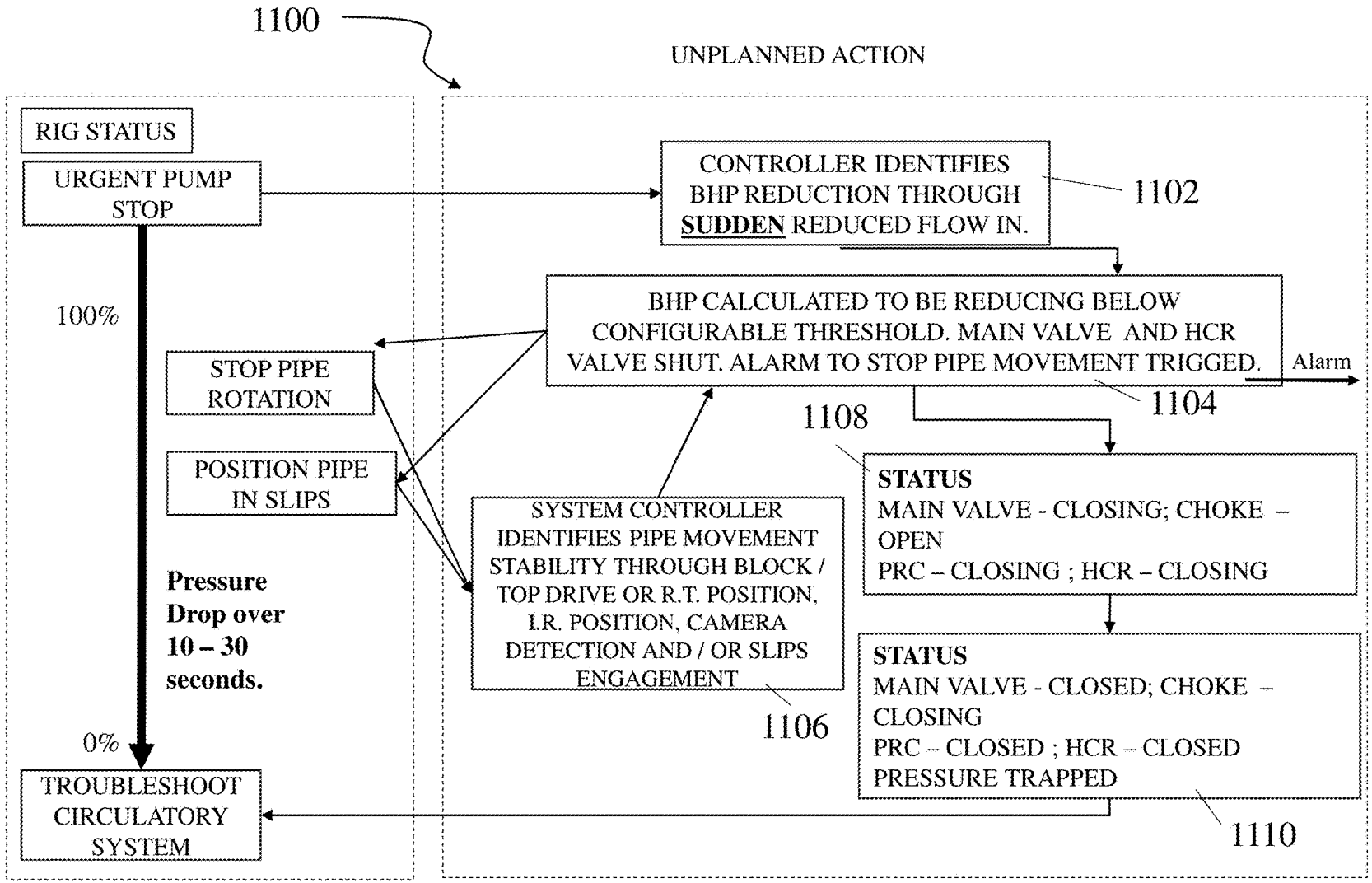
FIG. 11 is a flowchart that includes example steps performed by the controller in accordance with an unplanned annular pressure drop sequence.

FIG. 11 is a flowchart that includes example steps 1100 performed by the controller 704 in accordance with an unplanned annular pressure drop sequence. For example, the circulatory system associated with a drilling rig suddenly stops due to a power system failure or an activated safety electrical shutdown. Using information received over a data network, for example, from the pressure transmitter 706, the controller 704 identifies a sudden change in flow (step 1102). Such information can represent standpipe pressure, mud pump strokes parameters, or both. Using the parameter information, for example, the controller 704 identifies or calculates the reduction in bottomhole pressure (step 1104). For example, the controller 704 can use a calibration ramp schedule that is established through a calibration routine performed to establish the pressure change associated with change in flowrate or can run a simple hydraulic model to calculate the required surface pressure to trap or hold.

In one or more implementations, the controller 704 can receive information relating to the top drive's RPM, block position and speed, iron roughneck position or activation, slips engagement parameters, or information from other sensors, such as camera-based systems (step 1106). Using this information, the controller 704 determines pipe movement status. If the pipe is stationery, the controller 704 starts to close the main valve 304. If the pipe is not stationary, an operator alarm to stop pipe movement can be triggered. Depending on the amount of pipe movement compared to main valve 304 seal specifications and the criticality of annular pressure stability requirement, the controller 404 may still close main valve 304 with pipe movement present. Alternatively, if the controller 704 determines as a function of information received, for example, over a data network, that a pipe is reciprocating, then the controller waits to close the main valve 304 until the pipe is determined to be stationery. In case the controller 704 determines that the pipe is rotating (and not reciprocating), the controller 704 may also start to close the main valve 304 to complete a seal.

Continuing with reference to FIG. 11, at step 1104 and 1108, the controller 704 times the closing of the valve 306 shortly after the closing of the main valve 304. If the pressure relief choke 310 is determined to be open, the controller 704 rapidly closes the pressure relief choke 310. At step 1110, the main valve 304, valve 306, choke valve 308, and pressure relief choke 310 are all closed, and pressure is trapped. Thereafter, the drilling rig's circulatory system can go through troubleshooting to rectify any issue that caused the annular pressure drop (or other change). The sequence and timing of valve/choke closure can be calibrated or verified by the rig performing an example shutdown, and then by evaluating and tuning the system controller 704 response, accordingly.

In one or more implementations, valve 306 can perform primary trapping functions when a fast close is required, such as in response to an unplanned drop in pressure. Further, choke valve 308 can perform this task when a controlled pressure change is identified, such as in response to a planned drop in pressure. Moreover, pressure relief choke valve 310 can operate to provide fine pressure control in both scenario, including over pressure relief.

Figure 12:
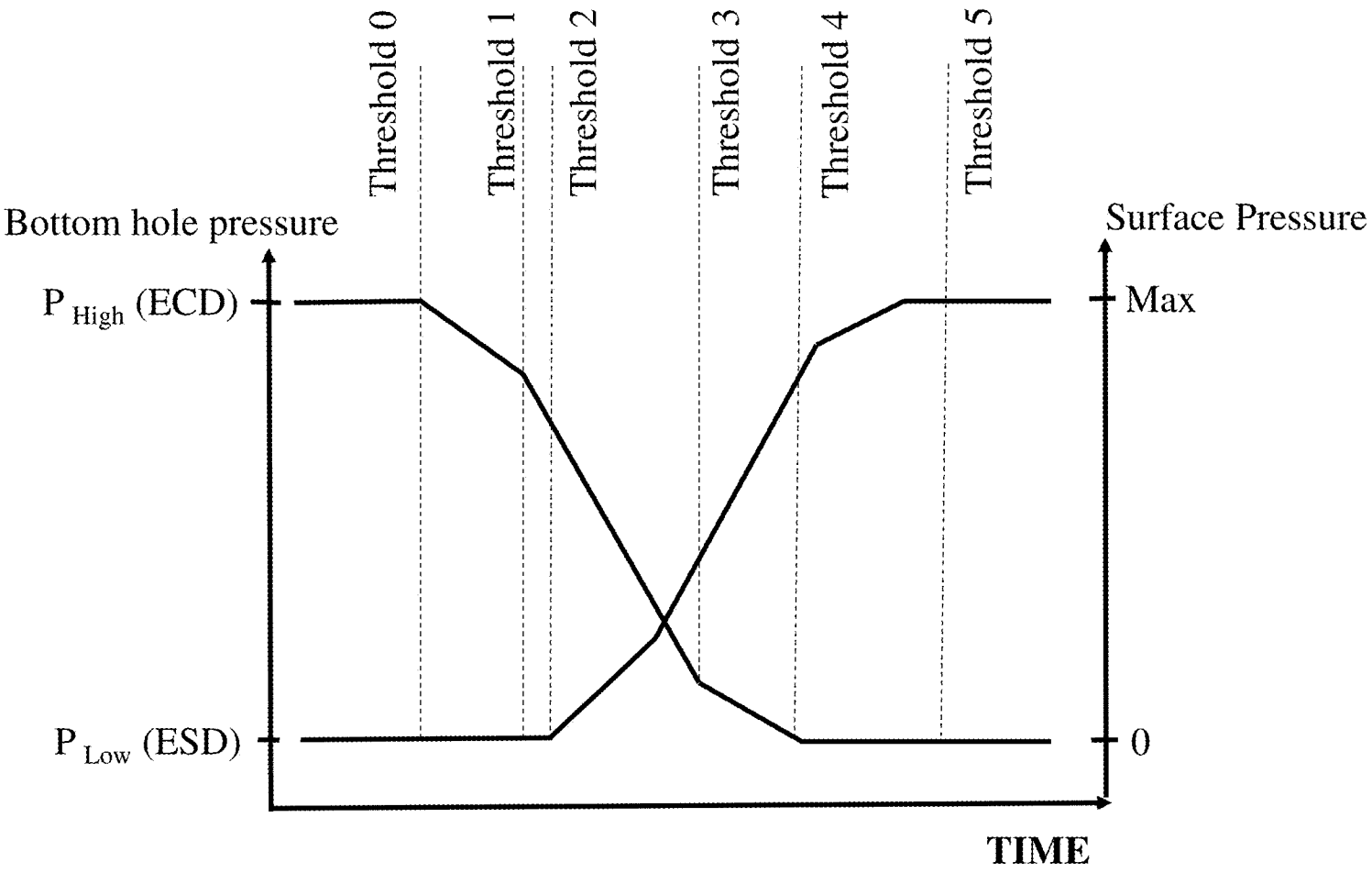
FIG. 12 shows an example state identification and typical response graph generated by, followed by, or both generated and followed by the controller, following a process of tuning or calibration.

FIG. 12 shows an example state identification and typical response graph generated by the controller 704, followed by the controller, or both generated and followed by the controller, following a process of tuning or calibration. The bottomhole pressure decreases as pipe movement stops and mud pump ramp down begins. In one or more implementations of the present disclosure, the corresponding surface pressure setpoint objective is known, allowing the controller to adjust the chokes and valves accordingly. More particularly, $P_{high}$ bottomhole pressure is known as a function of equivalent circulating density and $P_{low}$ bottomhole pressure is known as a function of equivalent static density are at the highest/lowest values, respectively, at threshold 0. Once the main valve 304 is closed, valve 306, choke valve 308, and pressure relief choke 310 also close to trap the required surface pressure. This may or may not occur before mud pump flow-in ceases. As the controller 704 detects the configurable thresholds when the flow-in reduces to zero, the main valve 304, choke 308 and, finally, pressure relief choke 310 are closed. In one or more implementations, pressure relief choke 310 is the last valve to close when flow in approaches zero. As noted herein, the pressure relief choke 310 can be open to bleed off pressure, as needed, when annular pressure stabilizes a few seconds after zero well flow (in and out). An interlock will prevent closure of choke valve 308 or valve 306 without main valve 304 being closed.

Figure 13:
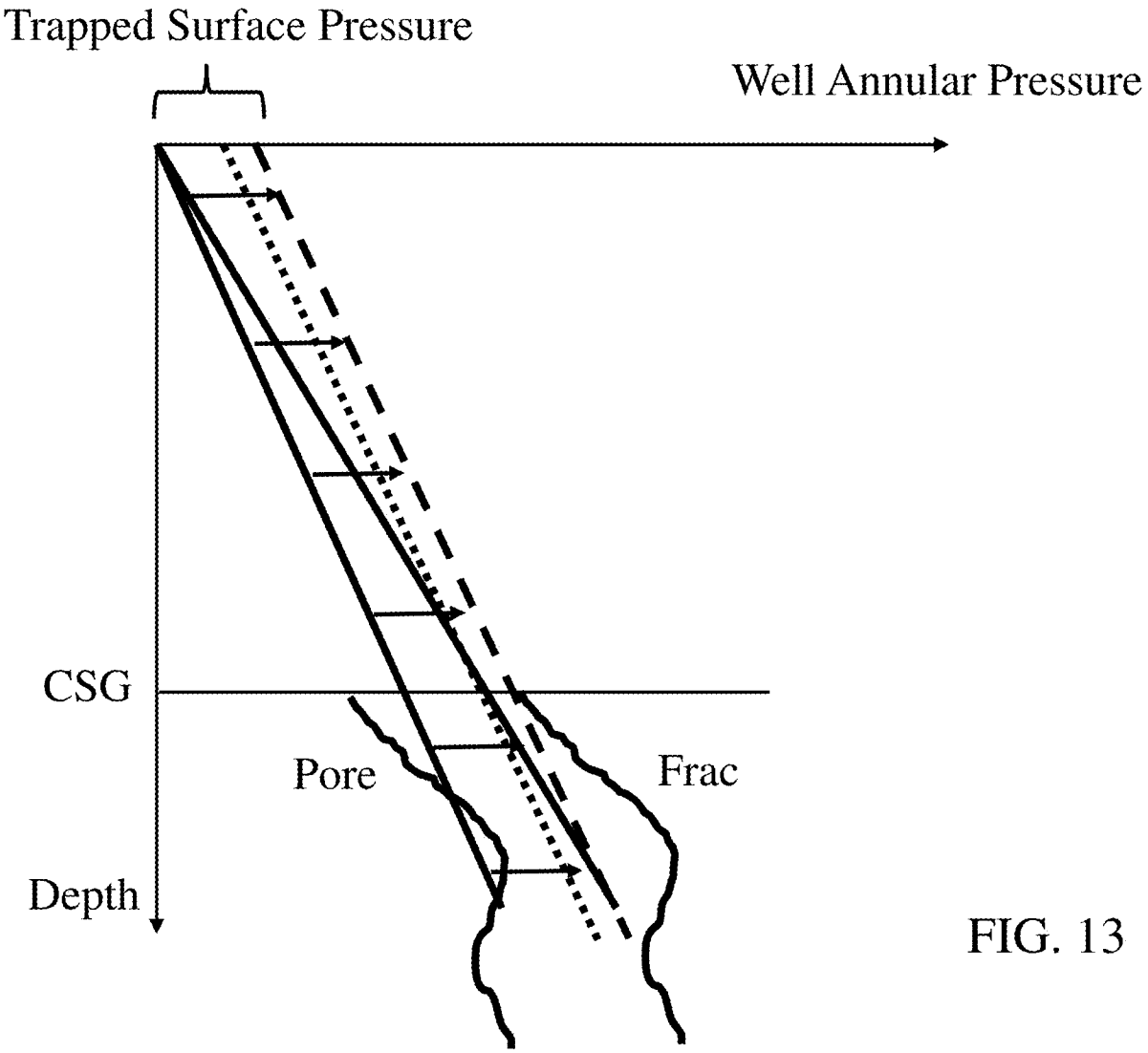
FIGS. 13 and 14 are example graphs that display plots of annular pressure at respective depths and represent how the selective application of surface pressure can offset changes in downhole pressure.
Figure 14:
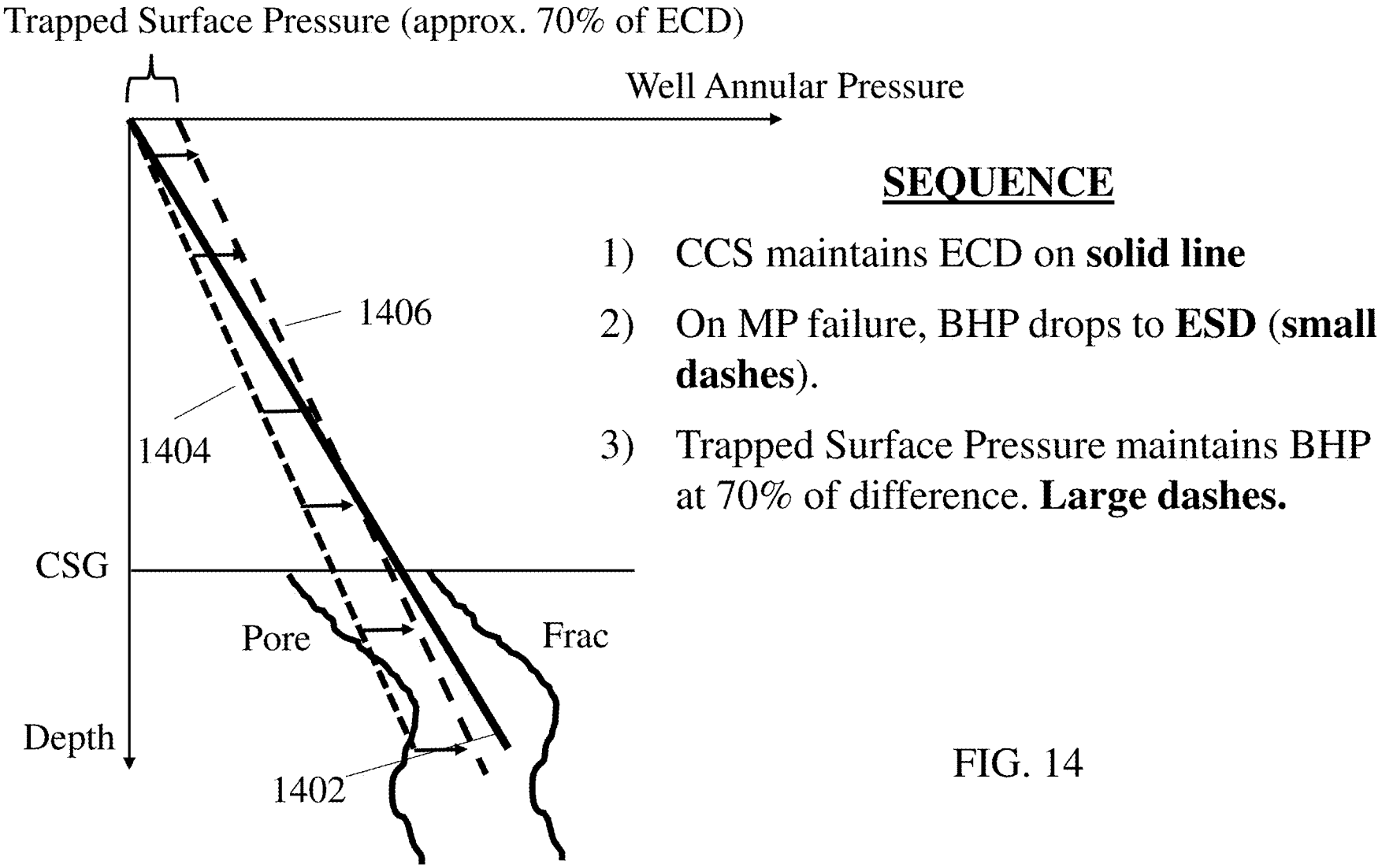

FIGS. 13 and 14 are example graphs that display plots of annular pressure at respective depths and represent how the selective application of surface pressure can offset changes in downhole pressure. FIG. 13, for example, shows a connection scenario and identifies trapped surface pressure. FIG. 14, for example, demonstrates a contingency for continuous circulatory system (CCS) failure. The continuous circulation system (not shown) maintains equivalent circulating density, which is represented by the solid line 1402. On continuous circulation system failure, bottomhole pressure drops to equivalent static density, as represented by small dashed lined 1404. In accordance with the teachings herein, the managed pressure drilling arrangement 302 causes trapped surface pressure to maintain bottomhole pressure greater than 70% of the equivalent circulating density, as represented by the large dashed line 1406. In other words, greater than 70% of the pressure ECD—ESD is applied at the surface.

Thus, as shown and described herein, the present disclosure provides systems and methods that can operate to improve the ability to maintain pressure stability in the event of known or planned drilling connections (when drilling and tripping pipe) and to provide a pressure trapping contingency in the event of the use of continuous circulation system in managed pressure drilling technology. Further, the present disclosure is fast-acting (less than 5 seconds) and provides a highly controllable seal between the drill string outside diameter and the well annulus, including as a function of main valve 304. Furthermore, the managed pressure drilling arrangement 302 reduces approximately 75% of the variation between $P_{high}$ (equivalent circulating density) and $P_{low}$ (equivalent static density), on appropriate well sections. Moreover, the teachings herein operate in combination with continuous circulation system managed technologies to provide a fast-acting annular pressure-trapping contingency in the event of circulatory system (e.g., mud pump) failure.

Yet another benefit of the present disclosure regards significantly increased life of the main valve 304 seal, and improved pressure rating. In accordance with one or more implementations of the present disclosure, the main valve 304 seal is retracted while rig pumps are circulating and during pipe moving, and the seal is only designed to seal around the drill pipe body, as opposed to tool joints. This preserves the life of the seal and the pressure rating will be considerably higher than conventional managed pressure drilling technology.

In one or more implementations of the present disclosure, all valves and chokes work in combination to ensure annular pressure stability within system specifications. Precise specifications are determined on a case-by-case basis through calibration and can vary depending upon a respective well section, hole volume and fluid properties. Moreover, in one or more implementations the controller 704 utilizes a series of thresholds or identifying characteristics on key rig system parameters to calculate the stage of the connection and sequence the appropriate Invention response to ensure the maintenance of bottomhole pressure stability. Yet another benefit of the present disclosure regards rig floor personnel protection, as the teachings herein provide a fast-acting emergency diverter in the event of suspected hydrocarbon escape at surface. Control can be affected manually, such as via a push button control, by the driller, or can be automatic and based on, for example, one or more inputs from sensors that detect, for example, hydrogen sulfide or other anomaly. Further, the present disclosure significantly reduces installation time (e.g., to get "rigged up") and uninstallation time ("rigged down") in less than 12 hours. This represents a large time savings over conventional systems, which can take over 36 hours to install/uninstall. Moreover, the present disclosure reduces the size of the workforce, and can operate with a dedicated crew of two persons (or even less). Conventional managed pressure drilling systems often require crews of up to eight people. Thus, the managed pressure drilling arrangement 302 is significantly more efficient and cost-effective than conventional systems. Moreover, the managed pressure drilling arrangement of the present disclosure eliminates complexities from a conventional, yet advanced, control system that relies on complex hydraulic models to calculate well annular pressure and to make choke adjustments to maintain downhole pressure stability based on desirable pressure "window" specifications. Further, an advanced conventional control system may require an accurate flowline flowmeter in order to measure whether the well is flowing or taking drilling fluids. Based on the measurement, a correcting level of backpressure may be needed to prevent influx (i.e., to increase surface backpressure) or to mitigate excessive fluid loss (i.e., to reduce surface backpressure). These requirements are eliminated by the managed pressure drilling arrangement of the present disclosure. The terms "a," "an," and "the," as used in this disclosure, means "one or more," unless expressly specified otherwise.

The present disclosure refers to computing technology, including network and communication devices, that can be integrated with or be accessible to drilling rigs. Such hardware/software associated therewith can mean any hardware, firmware, or software that can transmit or receive data packets, instruction signals or data signals over a communication link. The hardware, firmware, or software can include, for example, a telephone, a smart phone, a personal data assistant (PDA), a smart watch, a tablet, a computer, a software defined radio (SDR), or any respective components thereof, without limitation.

Communications within and between various devices shown and described herein can include a wired medium, a wireless medium, or a hybrid with both types of connections that convey data or information between at least two points. The wired or wireless medium can include, for example, a metallic conductor link, a radio frequency (RF) communication link, an Infrared (IR) communication link, an optical communication link, or the like, without limitation. The RF communication link can include, for example, Wi-Fi, WiMAX, IEEE 802.11, DECT, 0G, 1G, 2G, 3G or 4G cellular standards, Bluetooth, or the like, without limitation.

Further, one or more computers or computing devices can be included, with refer to any machine, device, circuit, component, or module, or any system of machines, devices, circuits, components, modules, or the like, which are capable of processing and manipulating data according to one or more instructions, such as, for example, without limitation, a processor, a microprocessor, a central processing unit, a general purpose computer, a super computer, a personal computer, a laptop computer, a palmtop computer, a notebook computer, a desktop computer, a workstation computer, a server, a server farm, a computer cloud, or the like, or an array of processors, microprocessors, central processing units, general purpose computers, super computers, personal computers, laptop computers, palmtop computers, notebook computers, desktop computers, workstation computers, servers, or the like, without limitation. Devices that are in communication with each other need not be in continuous communication with each other, unless expressly specified otherwise. In addition, devices that are in communication with each other may communicate directly or indirectly through one or more intermediaries.

Moreover, one or more computer-readable media are included in the present disclosure, which can refer to any storage medium that participates in providing data (for example, instructions) that can be read by a computing device. Such a medium can take many forms, including non-volatile media and volatile media. Non-volatile media can include, for example, optical or magnetic disks and other persistent memory. Volatile media can include dynamic random-access memory (DRAM). Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read. The computer-readable medium can include a "cloud," which includes a distribution of files across multiple (e.g., thousands of) memory caches on multiple (e.g., thousands of) computers.

Various forms of computer readable media can be involved in carrying sequences of instructions to a computer. For example, sequences of instruction (i) can be delivered from a RAM to a processor, (ii) can be carried over a wireless transmission medium, or (iii) can be formatted according to numerous formats, standards or protocols, including, for example, Wi-Fi, WiMAX, IEEE 802.11, DECT, 0G, 1G, 2G, 3G, 4G, or 5G cellular standards, Bluetooth, or the like.

The terms "transmission" and "transmit," as used in this disclosure, refer to the conveyance of signals via electricity, acoustic waves, light waves and other electromagnetic emissions, such as those generated in connection with communications in the radio frequency (RF) or infrared (IR) spectra. Transmission media for such transmissions can include coaxial cables, copper wire and fiber optics, including the wires that comprise a system bus coupled to the processor.

Further, the present disclosure can include a database, which can refer to any combination of software, hardware, or both, including at least one database and at least one computer. The database can include a structured collection of records or data organized according to a database model, such as, for example, but not limited to at least one of a relational model, a hierarchical model, a network model or the like. The database can include a database management system disclosure (DBMS) as is known in the art. The disclosure may include, but is not limited to, for example, any disclosure program that can accept connections to service requests from clients by sending back responses to the clients. The database can be configured to run the disclosure, often under heavy workloads, unattended, for extended periods of time with minimal human direction.

As used herein, the terms "including," "comprising" and variations thereof, as used in this disclosure, mean "including, but not limited to," unless expressly specified otherwise.

The term "network," as used in this disclosure means, but is not limited to, for example, at least one of a local area network (LAN), a wide area network (WAN), a metropolitan area network (MAN), a personal area network (PAN), a campus area network, a corporate area network, a global area network (GAN), a broadband area network (BAN), a cellular network, the Internet, or the like, or any combination of the foregoing, any of which can be configured to communicate data via a wireless or a wired communication medium. These networks can run a variety of protocols not limited to TCP/IP, IRC or HTTP.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

The invention encompassed by the present disclosure has been described with reference to the accompanying drawings, which form a part hereof, and which show, by way of illustration, example implementations. As such, the figures and examples above are not meant to limit the scope of the present disclosure to a single implementation, as other implementations are possible by way of interchange of some or all of the described or illustrated elements, without departing from the spirit of the present disclosure. Among other things, for example, the disclosed subject matter can be embodied as methods, devices, components, or systems.

Moreover, where certain elements of the present disclosure can be partially or fully implemented using known components, only those portions of such known components that are necessary for an understanding of the present disclosure are described, and detailed descriptions of other portions of such known components are omitted so as not to obscure the disclosure. In the present specification, an implementation showing a singular component should not necessarily be limited to other implementations including a plurality of the same component, and vice-versa, unless explicitly stated otherwise herein. Moreover, applicants do not intend for any term in the specification or claims to be ascribed an uncommon or special meaning unless explicitly set forth as such. Further, the present disclosure encompasses present and future known equivalents to the known components referred to herein by way of illustration.

Furthermore, it is recognized that terms used herein can have nuanced meanings that are suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter can be based upon combinations of individual example embodiments, or combinations of parts of individual example embodiments.

The foregoing description of the specific implementations will so fully reveal the general nature of the disclosure that others can, by applying knowledge within the skill of the relevant art(s) (including the contents of the documents cited and incorporated by reference herein), readily modify or adapt for various disclosures such specific implementations, without undue experimentation, without departing from the general concept of the present disclosure. Such adaptations and modifications are therefore intended to be within the meaning and range of equivalents of the disclosed implementations, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s). It is to be understood that dimensions discussed or shown of drawings are shown accordingly to one example and other dimensions can be used without departing from the present disclosure.

While various implementations of the present disclosure have been described above, it should be understood that they have been presented by way of example, and not limitation. It would be apparent to one skilled in the relevant art(s) that various changes in form and detail could be made therein without departing from the spirit and scope of the disclosure. Thus, the present disclosure should not be limited by any of the above-described example implementations, and the invention is to be understood as being defined by the recitations in the claims which follow and structural and functional equivalents of the features and steps in those recitations.

What is claimed:

1. A method for controlling annular well pressure during a pipe connection process in a managed pressure drilling rig, the method comprising:

identifying, by a controller which is configured with at least one processor, pipe movement stability, wherein the pipe movement stability is identified as a function of information representing stoppage of pipe rotation, positioning of a pipe in slips, or both stoppage of pipe rotation and positioning of a pipe in slips;

determining, by the controller in response to information representing a pump ramp down process, well bottomhole pressure that is below a predetermined threshold value;

closing, by the controller in response to the well bottomhole pressure being below the predetermined threshold value, a main valve configured with the managed pressure drilling rig, while maintaining, by the controller, a second valve in an open position and a first choke in an open position, wherein the second valve and the first choke are also configured with the managed pressure drilling rig; and closing, by the controller after the main valve is closed, at least one of the first choke and a second choke, and maintaining, by the controller, the second valve in the open position, wherein the bottomhole pressure is trapped as a function of the main valve and at least one of the first choke and the second choke being closed sequentially, and further wherein the annular well pressure is maintained as a function of the trapped pressure, thereby enabling breakage of the pipe connection without further reducing the bottomhole pressure.

2. The method of claim 1, wherein the information representing stoppage of pipe rotation or positioning of a pipe in slips is received from a pressure transmitter that is configured with the managed pressure drilling rig to measure pressure and transmit, to the controller, information representing pressure, component operational status, drilling rig performance, or a combination of the foregoing.

3. The method of claim 1, further comprising establishing, by the controller as a function of a calibration ramp schedule, a pressure change associated with a change in flow rate in accordance with the pump ramp down process.

4. The method of claim 1, wherein the information representing stoppage of pipe rotation or positioning of a pipe in slips is derived from top drive revolutions per minute, rotary table position, block position, iron roughneck activation, slips activation, or at least one image captured by a camera, or a combination of the foregoing.

5. The method of claim 1, wherein closing, by the controller, the main valve prior to closing, by the controller, at least one of the first choke and the second choke is in accordance with information representing a continuing of the pump ramp down process.

6. The method of claim 1, further comprising closing, by the controller after the main valve is closed, the first choke, the second choke, or the first choke and the second choke to control the well bottomhole pressure.

7. The method of claim 1, wherein the second choke is further configured to provide fine pressure stability control and to act as a pressure relief valve in response to overpressure.

8. The method of claim 1, wherein the second valve is a hydraulically controlled or pneumatically controlled gate valve.

9. A method for controlling annular well pressure during an unexpected interruption during operation of a managed pressure drilling rig, the method comprising:

identifying, by a controller which is configured with at least one processor, a reduction in well bottomhole pressure as a function of information representing reduced flow;

closing, by the controller in response to the well bottomhole pressure being below a predetermined threshold value, a main valve and a second valve which are configured with the managed pressure drilling rig, while maintaining, by the controller, a choke valve configured with the managed pressure drilling rig in an open position wherein, when in a closed position, the main valve and the second valve operate to trap the bottomhole pressure;

closing, by the controller after the main valve and the second valve are closed, a pressure relief choke valve configured with the managed pressure drilling rig, wherein the pressure relief choke valve operates as a pressure controlling valve; and closing, by the controller after the pressure relief choke valve is closed, the choke valve, wherein the bottomhole pressure is trapped as a function of the main valve, the second valve, the pressure relief choke valve and the choke valve being closed, thereby enabling troubleshooting a cause of the unexpected interruption.

10. The method of claim 9, further comprising generating, by the controller, an alarm to stop pipe movement, wherein the alarm is generated in response to the well bottomhole pressure being below a predetermined threshold value.

11. The method of claim 9, wherein the reduced flow is derived as a function of derived standpipe pressure or pump strokes parameters.

12. The method of claim 9, wherein the information representing the reduced flow is received from a pressure transmitter that is configured with the managed pressure drilling rig to measure pressure and transmit, to the controller, information representing pressure, component operational status, drilling rig performance, or a combination of the foregoing.

13. The method of claim 9, wherein the pressure relief choke valve is further configured to provide fine pressure stability control and to act as a pressure relief valve in response to overpressure.

14. The method of claim 9, wherein the second valve is a hydraulically controlled or pneumatically controlled gate valve.

15. A fast-acting managed pressure drilling rig for a well, comprising:

a main valve configured as an alternative for a conventional rotating control device to control drilling of a wellbore;

a second valve configured to trap pressure in the wellbore;

a choke valve, designed to maintain well bottomhole pressure within specified limits by trapping pressure or by releasing trapped pressure within the wellbore;

a pressure relief choke valve configured to provide fine pressure stability control within the well and to act as a pressure relief valve in response to wellbore overpressure; and a controller configured with at least one processor, wherein the controller receives information representing stoppage of pipe rotation, positioning of a pipe in slips, or both stoppage of pipe rotation and positioning of a pipe in slips, and further wherein, in response to the received information, the controller:

closes the main valve; and closes the choke valve while maintaining the second valve in an open position.

16. The managed pressure drilling rig of claim 15, wherein the main valve is further configured to provide rapid sealing between a drill string outside diameter and a well annulus.

17. The managed pressure drilling rig of claim 15, wherein the main valve, the second valve, the choke valve, and the pressure relief choke are controllable by the controller as a function of inputs received over a data network.

18. The managed pressure drilling rig of claim 15, wherein the controller is configured to respond to characteristics of components in the rig and to provide responses the identify a respective stage of a connection, and wherein the controller is further configured to maintain bottomhole pressure stability in the wellbore by controlling the main valve, the second valve, the choke valve, and the pressure relief choke.

19. The managed pressure drilling rig of claim 15, wherein the second valve is a hydraulically controlled or pneumatically controlled gate valve.

* * * * *